US005215363A

United States Patent [19]

Warwick, III

[11] Patent Number: 5,215,363

[45] Date of Patent: Jun. 1, 1993

[54] TRASH COLLECTION APPARATUS

[76] Inventor: William C. Warwick, III, 2609 Timothy Dr., Fuquay-Varina, N.C. 27526

[21] Appl. No.: 826,047

[22] Filed: Jan. 27, 1992

[51] Int. Cl.[5] ..... A47B 77/10

[52] U.S. Cl. ..... 312/274; 312/311; 312/319.8

[58] Field of Search ..... 312/311, 319, 273, 274, 312/319.8

[56] References Cited

U.S. PATENT DOCUMENTS 2,247,232 6/1941 Goldberg ..... 312/274
2,530,336 11/1950 Marini ..... 312/319 X
2,709,635 5/1955 Garani ..... 312/319 X
4,682,424 7/1987 Irving ..... 312/273 X
5,031,975 7/1991 Anderson ..... 312/319

*Primary Examiner*—Peter R. Brown
*Attorney, Agent, or Firm*—Leon Gilden

[57] ABSTRACT

An apparatus includes a container member slidably mounted between spaced parallel container support side walls, wherein the container support side walls are mounted within a cabinet housing. The container support includes a gear rack mounted from the container support to a rear wall of the container member, and further includes a lid control cable extending from the container member to the lid directed through cooperative pulleys to effect simultaneous opening of the lid upon projection of the container member exteriorly of the cabinet housing relative to the spaced container support side wall.

1 Claim, 5 Drawing Sheets

TRASH COLLECTION APPARATUS

BACKGROUND OF THE INVENTION

1. Field of the Invention

The field of invention relates to trash collection apparatus, and more particularly pertains to a new and improved trash collection apparatus wherein the same is arranged to mount a container support for reciprocation relative to and from within a cabinet housing permitting simultaneous opening of the container member lid, as well as the cabinet housing front wall door.

2. Description of the Prior Art

Trash collection apparatus of various types are utilized throughout the prior art to receive various refuse components therewithin. Refuse disposal relative to a kitchen environment, particularly for individuals involved with a busy life-style as well as limited physical abilities, require additional convenience in the provision of disposal of refuse relative to a kitchen environment. Prior art kitchen refuse apparatus is avaiable in the prior art to include U.S. Pat. No. 4,813,087 to Sperka, et al. setting forth a kitchen sink unit utilizing a refuse disposal opening therethrough.

U.S. Pat. No. 3,647,102 to Cooley sets forth a garage and trash container arranged for decorative camouflage.

U.S. Pat. No. 4,401,312 to Parker sets forth an automatic trash collection receptacle.

U.S. Pat. No. 4,896,593 to Slusser sets forth an example of a trash compactor for compacting of trash components therewithin.

It may be appreciated, however, that there continues to be a need for a new and improved trash collection apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of trash collection apparatus now present in the prior art, the present invention provides a trash collection apparatus wherein the same provides for a support organization to permit the simultaneous lid and cabinet opening of a container member positioned within a cabinet housing to provide access to the container member for trash disposal. As such, the general purpose of the present invention, which will be described subsequently in greater detail, is to provide a new and improved trash collection apparatus which has all the advantages of the prior art trash collection apparatus and none of the disadvantages.

To attain this, the present invention provides an apparatus including a container member slidably mounted between spaced parallel container support side walls, wherein the container support side walls are mounted within a cabinet housing. The container support includes a gear rack mounted from the container support to a rear wall of the container member, and further includes a lid control cable extending from the container member to the lid directed through cooperative pulleys to effect simultaneous opening of the lid upon projection of the container member exteriorly of the cabinet housing relative to the spaced container support side wall.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved trash collection apparatus which has all the advantages of the prior art trash collection apparatus and none of the disadvantages.

It is another object of the present invention to provide a new and improved trash collection apparatus which may be easily and efficiently manufactured and marketed.

It is a further object of the present invention to provide a new and improved trash collection apparatus which is of a durable and reliable construction.

An even further object of the present invention is to provide a new and improved trash collection apparatus which is susceptible of a low cost of manufacture with regard to both materials and labor, and which accordingly is then susceptible of low prices of sale to the consuming public, thereby making such trash collection apparatus economically available to the buying public.

Still yet another object of the present invention is to provide a new and improved trash collection apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
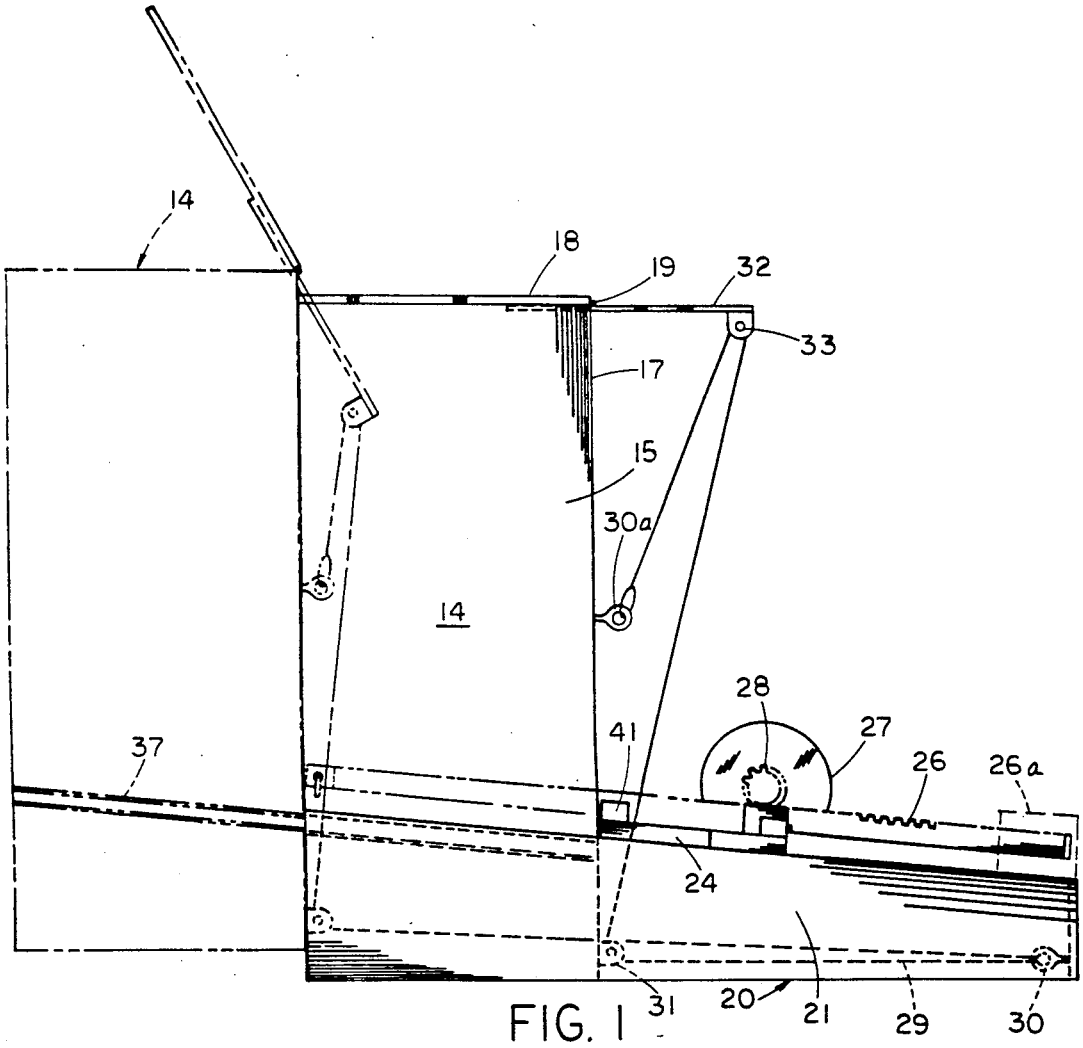
FIG. 1 is an orthographic side view of the instant invention.
Figure 2:
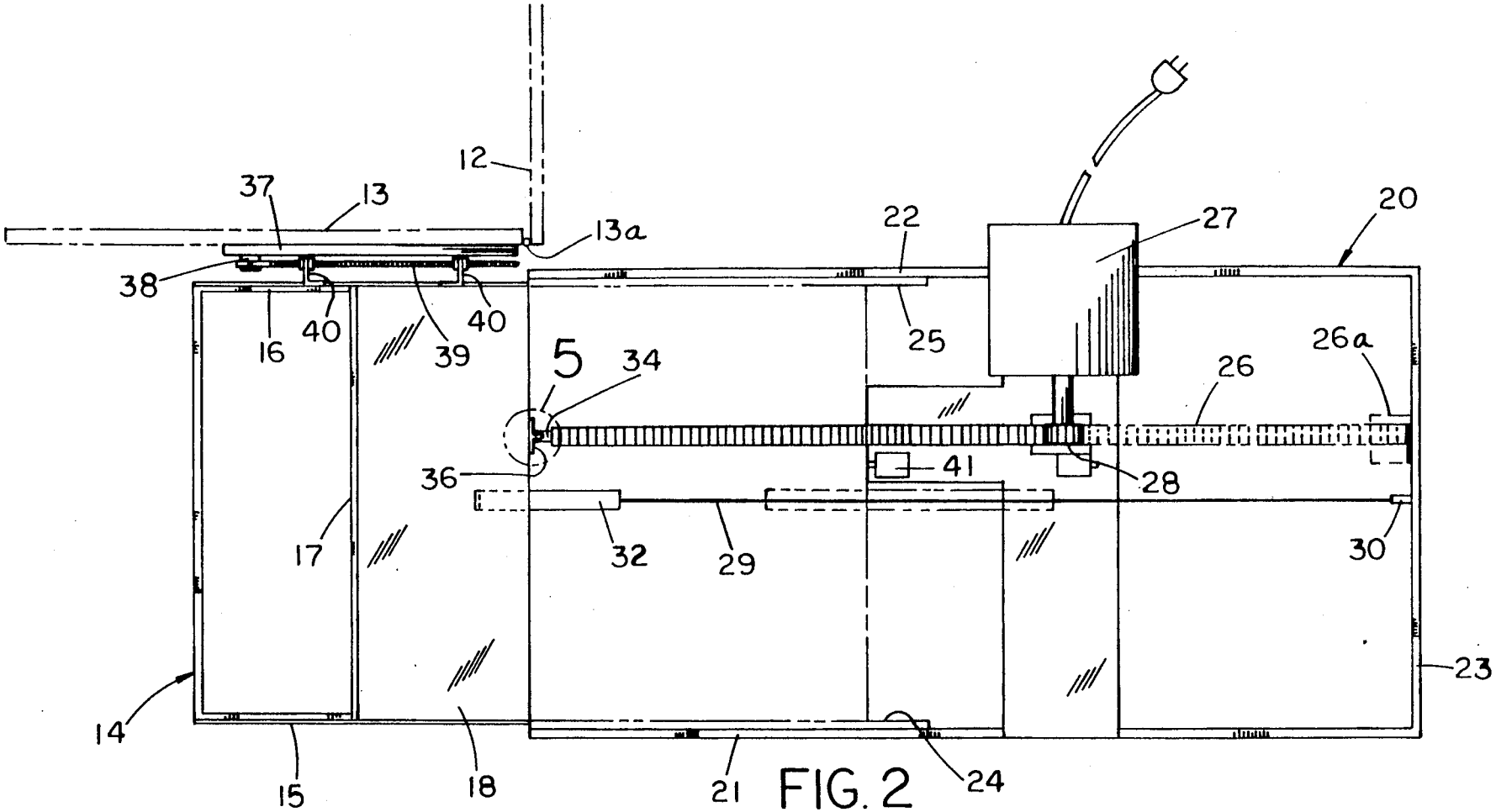
FIG. 2 is an orthographic top view of the instant invention.
Figure 3:
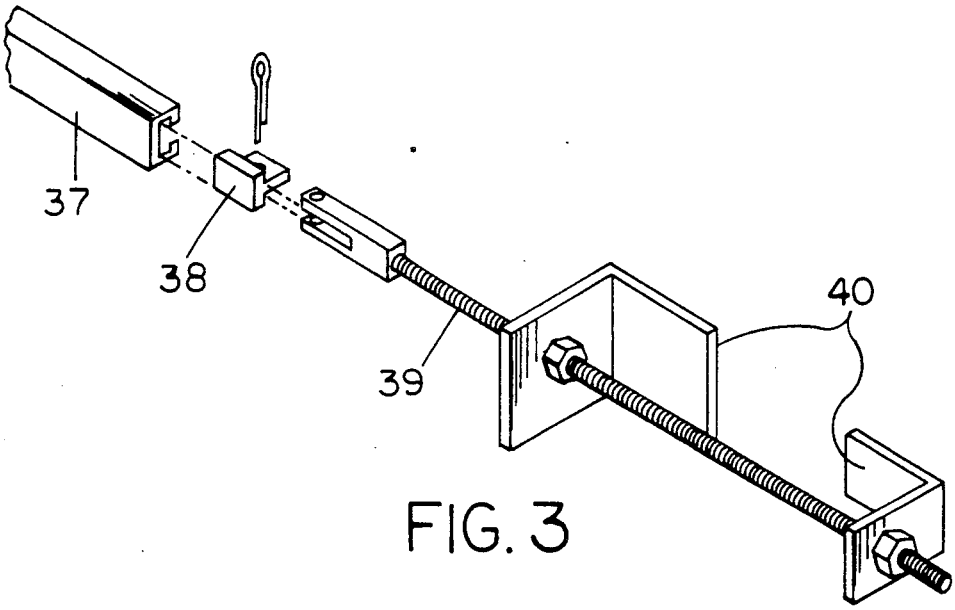
FIG. 3 is an isometric illustration of the door control structure of the invention.
Figure 5:
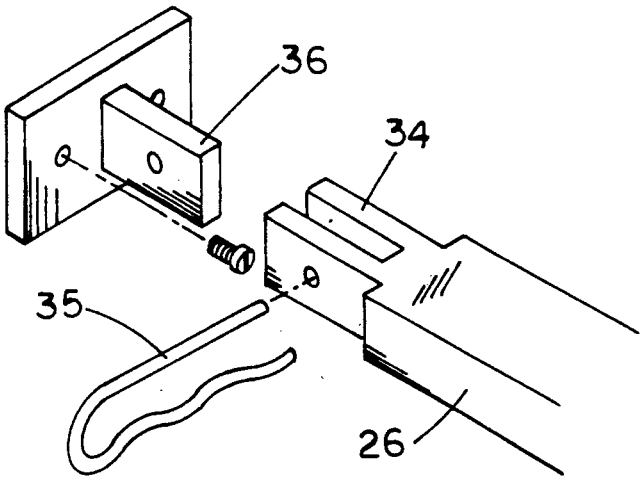
FIG. 5 is an isometric illustration of a forward mounting of the gear rack structure.
Figure 4:
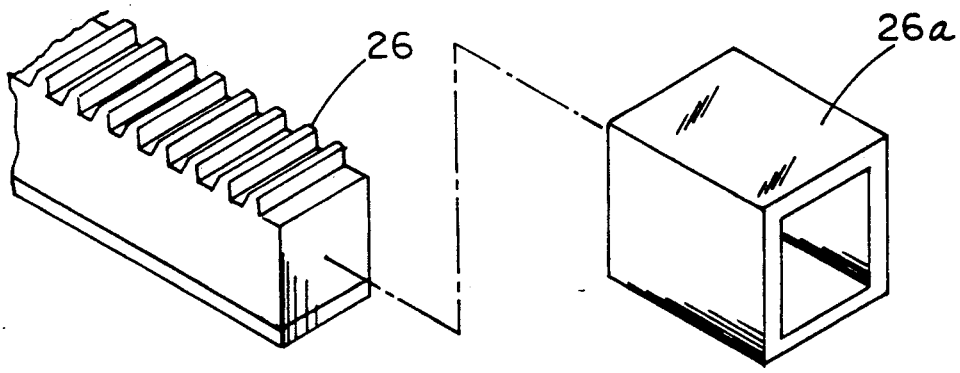
FIG. 4 is an isometric illustration of a rear mounting of the gear rack structure of the invention.

With reference now to the drawings, and in particular to FIGS. 1 to 6 thereof, a new and improved trash collection apparatus embodying the principles and concepts of the present invention and generally designated by the reference numeral 10 will be described.

Figure 6:
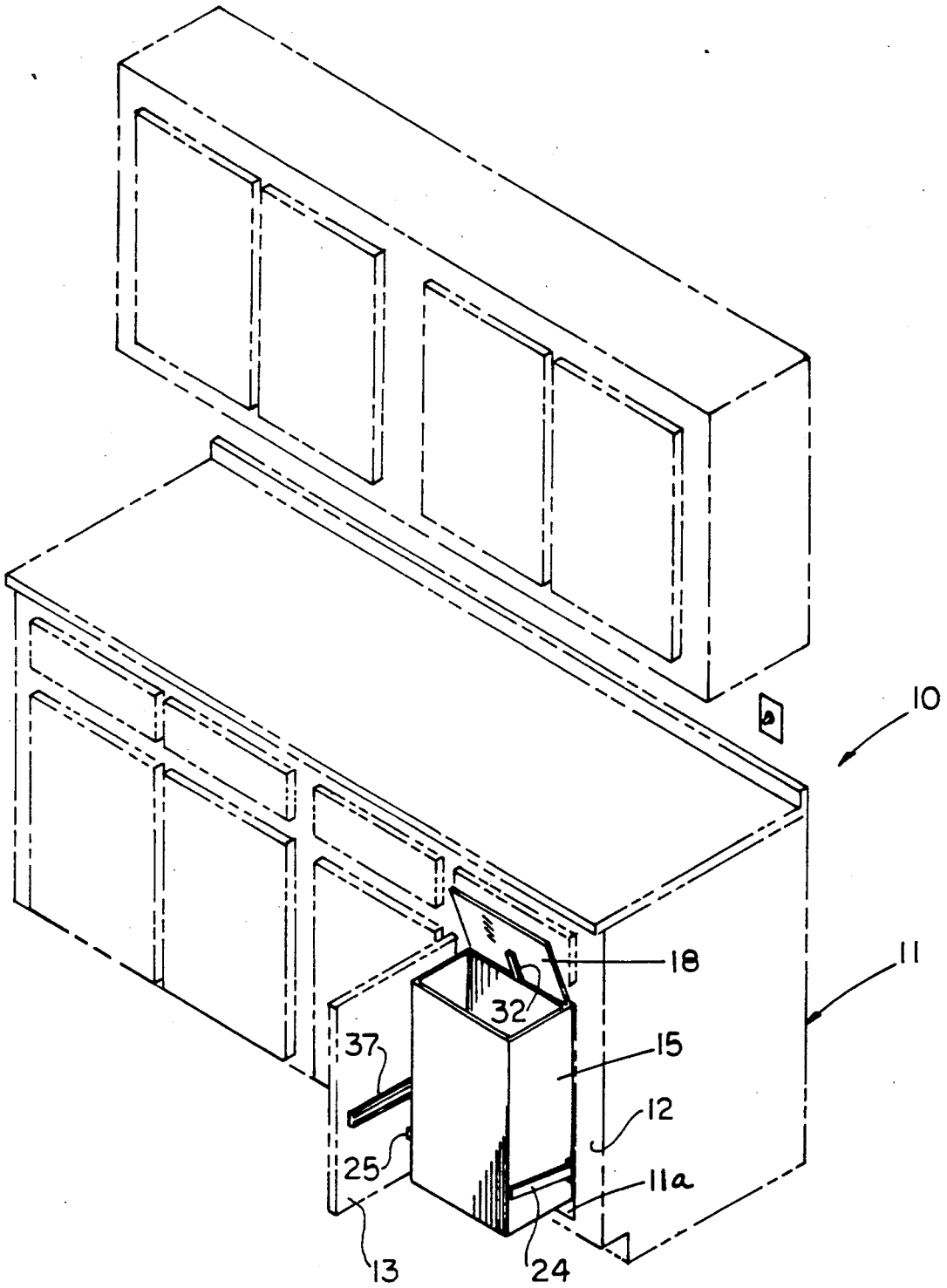
FIG. 6 is an isometric illustration of the invention mounted within an associated cabinet housing.

More specifically, the trash collection apparatus 10 of the instant invention essentially comprises a cabinet housing, such as illustrated in the FIG. 6, defined by the cabinet housing 11, including a housing front wall 12 to include a front wall door 13. The cabinet housing 11 in this manner defines a cabinet housing cavity 11*a* receiving a container member 14 therewithin. The container member 14 projects through the cabinet housing front wall 12 upon displacement of the front wall door 13 relative to the front wall 12 about a door hinge 13*a* mounted to the door 13 and the front wall 12, in a manner as illustrated in the FIG. 2.

The container member 14 includes a container first side wall 15 spaced from and parallel a container member second side wall 16, with a container member rear wall 17 projecting orthogonally between the first side wall and second side wall 15 and 16 coextensive therewith in a vertical orientation. A container lid 18 is hingedly mounted to the container rear wall 17 about a lid hinge 19 (see FIG. 1). A container support 20 is spaced parallel container support first and second side walls 21 and 22 that are arranged in parallel adjacencies to the respective container member first and second side walls 15 and 16. A container support rear wall 23 is orthogonally directed between rear distal ends of the container support first and second side walls 21 and 22. A respective first and second guide track 24 and 25 is fixedly mounted to the respective container member first and second side walls 15 and 16 (see FIGS. 2 and 6) that are slidably received within interior surfaces of the respective container support first and second side walls 21 and 22 to permit sliding guidance of the container member 14 to a first position within the container housing cavity 11*a* to a second position projecting from the container housing cavity 11*a* with the front wall door 13 swung to an open orientation, as illustrated in FIG. 6.

An elongate gear rack 26 is orthogonally directed between the container support rear wall 23 and the container member rear wall 17. The elongate gear rack 26 includes a gear rack bifurcated front end 34 (see FIG. 5) that is pivotally mounted to a gear rack container mounting flange 36 mounted to the container member rear wall 17. A gear rack axle 35 effects pivotment of the gear rack bifurcated forward end 34 to the container mounting flange 36. A rear distal end of the gear rack 26 is arranged for sliding projection through a gear rack guide tube (see FIG. 1) to provide guidance of the gear rack relative to the rear wall as the gear rack is directed reciprocatably past the drive motor 27. The gear rack guide sleeve 26*a* mounted to the container support rear wall 23 merely provides guidance and the rear sliding therethrough of the gear rack 26 as it is reciprocated rearwardly past the drive motor 27.

A control cable 29 includes a rear distal end mounted to a first cable anchor 30 that is secured to the container support rear wall 23. A first pulley 31 mounted to the container member rear wall 17 directs the lid control cable 29 thereabout, with the lid control cable 29 directed upwardly about a second pulley 33 mounted to an outer distal end of a lid control plate 32 fixedly mounted orthogonally and projecting rearwardly of the container lid 18. A second distal end of the lid control cable 29 is fixedly mounted to a second anchor 30*a* to the container member rear wall 17 spaced above the first pulley 31.

A door track 37 (see the FIGS. 1, 2, and 6) is mounted to an interior surface of the cabinet housing front wall door 13, and includes a door track follower 38 slidably guided therewithin. The follower 38 is mounted to a door actuator rod 39 that in turn is secured to support bracket 40 that is secured to the container member second side wall 16. If required, limit switches 41 may be provided to effect limiting of travel of the container member 14 relative to the container support 20 and the cabinet housing 11.

It should be further noted that various modifications may be employed without departing from the spirit and scope of the invention. For example, the guide track sleeve 26*a* may be pivotally mounted relative to the rear wall to accommodate various manufacturing deviations in construction when the guide track 26 is directed through the sleeve 26*a* in its traverse of the drive motor 27.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A trash collection apparatus, comprising, a cabinet housing, the cabinet housing defining an enclosure to include a housing front wall, the front wall including a front wall door hingedly mounted to the front wall about a door hinge, and the cabinet housing including a housing cavity rearwardly of the door, and a container support positioned within the housing cavity, the container support including a container support first side wall spaced from and parallel a container support second side wall, and a container member slidably mounted between the container support first side wall and the container support second side wall, and drive means to effect reciprocation of the container member relative to the container support from a first position interiorly of the housing cavity to a second position exteriorly of the housing cavity, and the container member includes a container member rear wall extending coextensively between the container support first side wall and the container support second side wall, and a container lid hingedly mounted to the container rear wall about a lid hinge, the container member having a container first side wall and a container second side wall, and the container support including a container support rear wall mounted to the container support first side wall and the container support second side wall within the housing cavity, and a first guide track mounted to the container first side wall and a second guide track mounted to the container second side wall, wherein the respective first guide track and second guide track are slidably mounted to the container support first side wall and the container support second side wall respectively, and an elongate gear rack, the elongate gear rack includes a forward distal end, the elongate gear rack forward distal end includes an axle directed therethrough, and the axle directed through a container mounting flange, with the container mounting flange fixedly mounted to the container member rear wall, and the gear rack rear distal end slidably received within a guide sleeve, the guide sleeve mounted to the container support rear wall to slidably guide the gear rack therethrough, said drive means including a drive motor mounted to the container support, the drive motor including a drive gear in operative communication with the gear rack to effect communication with the gear rack to effect reciprocation of the gear rack relative to the drive motor, and a lid control cable, with the cable having a first end and a second end, and the container support further including a first anchor mounted to the container support rear wall, and the first end secured to the first anchor, and the container member including a second anchor, the second anchor mounted to an exterior surface of the container member rear wall, with the second end secured to the second anchor, and first pulley mounted to the container member rear wall below the second anchor receiving the lid control cable therethrough, and a lid control plate fixedly mounted to the container lid extending orthogonally rearwardly thereof, with a second pulley mounted to the lid control plate spaced from the container member rear wall, with the lid control cable directed through the second pulley, and the front wall door includes a door track fixedly mounted thereto, the door track including a follower slidably guided within the door track, the follower pivotally mounted to a door actuator rod at a forward distal end of the actuator rod, and the door actuator rod secured within a support bracket structure, with said support bracket structure mounted to the container member second side wall, whereby directing the container member through the front wall door from a first position within the housing cavity to a second position projecting the container member from the housing cavity and pivots the front wall door to receive the container member therealong and simultaneously pivots the container lid about the lid hinge.

* * * * *